US012742460B1

(12) United States Patent
Strle et al.

(10) Patent No.: US 12,742,460 B1
(45) Date of Patent: Sep. 22, 2026

(54) FAN SHROUD WITH FLOW DIRECTING DEFLECTORS

(71) Applicant: Unada Company Limited, Bangmuang (TH)

(72) Inventors: Eduardo Strle, Mueang Nonthaburi (TH); Vinícius Burigo Neto, Florianópolis (BR)

(73) Assignee: Unada Company Limited, Bangmuang (TH)

( * ) Notice: Subject to any disclaimer, the term of this patent is extended or adjusted under 35 U.S.C. 154(b) by 0 days.

(21) Appl. No.: 19/226,118

(22) Filed: Jun. 2, 2025

(51) Int. Cl.
*F04D 29/54* (2006.01)
*F04D 19/00* (2006.01)

(52) U.S. Cl.
CPC ..... *F04D 29/542* (2013.01); *F04D 19/002* (2013.01)

(58) Field of Classification Search
CPC ..... F04D 19/002; F04D 29/54; F04D 29/541; F04D 29/542; F04D 29/544
See application file for complete search history.

(56) References Cited

U.S. PATENT DOCUMENTS

| | | | | |
|---|---|---|---|---|
| 7,238,006 | B2 * | 7/2007 | Studebaker | E04B 1/7092 415/121.2 |
| 10,920,792 | B2 * | 2/2021 | Xiao | B01D 46/0047 |
| 11,655,824 | B2 * | 5/2023 | Cote | F04D 29/329 417/423.1 |
| 12,221,981 | B2 * | 2/2025 | Alaoui Benzakroum | F04D 29/522 |
| 2002/0131863 | A1 * | 9/2002 | Cheng | F04D 19/002 415/219.1 |
| 2009/0101315 | A1 * | 4/2009 | Cheng | F04D 29/582 165/104.31 |

* cited by examiner

*Primary Examiner* — Justin D Seabe
(74) *Attorney, Agent, or Firm* — D. Tiller Law PLLC; Don Tiller

(57) ABSTRACT

A shroud for an axial fan includes a plurality of air-deflector vanes positioned on the pressure side of the fan impeller. Each vane has a surface oriented at an angle to the axial direction that is between 0 and 90 degrees. Preferably, the angle is between 40 and 60 degrees. Each vane has a longitudinal axis and the vanes are oriented so that these axes are approximately but not necessarily exactly parallel to each other and are approximately but not necessarily exactly perpendicular to the axial direction. Preferably, the axes are oriented within 5 degrees of each other and within 5 degrees of perpendicular to the axial direction.

16 Claims, 5 Drawing Sheets

FAN SHROUD WITH FLOW DIRECTING DEFLECTORS

BACKGROUND AND SUMMARY

This invention pertains generally to cooling fans used in space constrained applications such as refrigeration applications. More specifically, the invention is directed to a fan shroud with air deflectors on the pressure side of the fan that are configured to increase the uniformity of the air flow across the evaporator coils of a heat exchanger.

There is a great incentive to minimize the space taken by cooling equipment in retail refrigerator and freezer cabinets (collectively, "cooling cabinets"). These retail cabinets are used to store and display refrigerated or frozen items for purchase by the public. Generally, by increasing the capacity of the cabinet to make products available to the consuming public one can lower the storage and display costs associated with selling the product. Thus, the more room the cooling equipment takes, the higher the selling costs, all else being equal.

This space constraint on cooling equipment creates challenges for cooling efficiency. The typical equipment will include a fan positioned to draw air from the front of the cabinet and blow the air through the evaporator coil of a heat exchanger to the back of the cabinet. The fan thus generates circulation of cooled air across the product in the cabinet. Because of the space constraint and flow volume requirement, a fan is typically installed at angle to the evaporator coils in a small cooling section of the cabinet. This leads to less than desirable air flow, often turbulent or chaotic, within the cooling section of the cabinet which in turn lowers the cooling efficiency. Lower cooling efficiency in turn increases the cost of sales.

Accordingly, there is a need for technology to improve the air flow across the evaporator of a cooling unit in a cooling cabinet.

In an aspect of the invention, a fan shroud is configured with a plurality of elongate deflector vanes on the pressure side of the fan. The deflector vanes are not mutually intersecting and each is positioned to intersect, and deflect, a different area of the fan output airflow. Each vane has a longitudinal axis along its length and this axis is oriented roughly perpendicular to the output airflow, preferably between 90 and 100 degrees to the flow axis. In a preferred embodiment, the longitudinal axes may vary one from the other up to about 5 degrees. The deflector vanes each have a surface facing the output airflow at an angle between about 40 to 60 degrees of the direction of the flow. Some or all of these flow-facing surfaces may be concave. Some or all of the surfaces may have different curvatures from the others.

BRIEF DESCRIPTION OF THE DRAWINGS

These and other features, aspects, and advantages of the present invention will become better understood with reference to the following description, appended claims, and accompanying drawings where:

DETAILED DESCRIPTION

Figure 1:
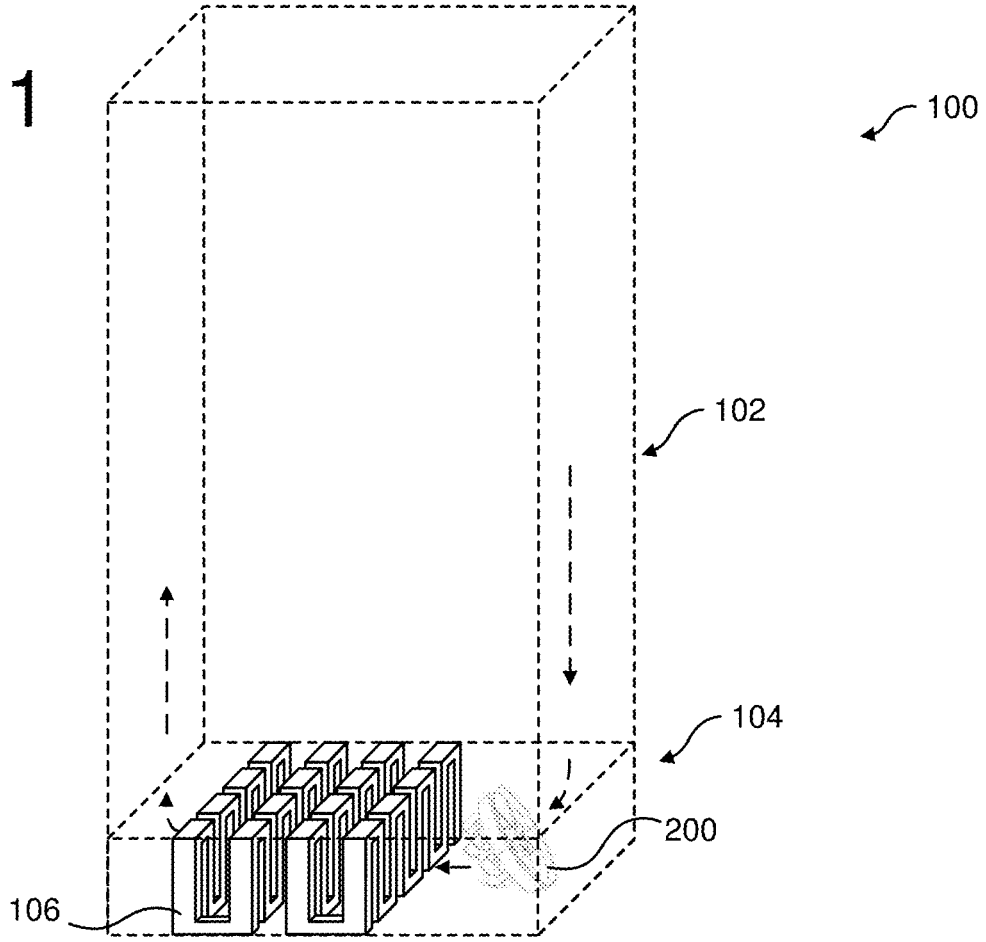
FIG. 1 is a 3D view illustrating an exemplary cooling cabinet with a fan according to an aspect of the invention.

In the summary above, and in the description below, reference is made to particular features of the invention in the context of exemplary embodiments of the invention. The features are described in the context of the exemplary embodiments to facilitate understanding. But the invention is not limited to the exemplary embodiments. And the features are not limited to the embodiments by which they are described. The invention provides a number of inventive features which can be combined in many ways, and the invention can be embodied in a wide variety of contexts. Unless expressly set forth as an essential feature of the invention, a feature of a particular embodiment should not be read into the claims unless expressly recited in a claim.

Except as explicitly defined otherwise, the words and phrases used herein, including terms used in the claims, carry the same meaning they carry to one of ordinary skill in the art as ordinarily used in the art.

Because one of ordinary skill in the art may best understand the structure of the invention by the function of various structural features of the invention, certain structural features may be explained or claimed with reference to the function of a feature. Unless used in the context of describing or claiming a particular inventive function (e.g., a process), reference to the function of a structural feature refers to the capability of the structural feature, not to an instance of use of the invention.

Except for claims that include language introducing a function with "means for" or "step for," the claims are not recited in so-called means-plus-function or step-plus-function format governed by 35 U.S.C. § 112(f). Claims that include the "means for [function]" language but also recite the structure for performing the function are not means-plus-function claims governed by § 112(f). Claims that include the "step for [function]" language but also recite an act for performing the function are not step-plus-function claims governed by § 112(f).

Except as otherwise stated herein or as is otherwise clear from context, the inventive methods comprising or consisting of more than one step may be carried out without concern for the order of the steps.

The terms "comprising," "comprises," "including," "includes," "having," "haves," and their grammatical equivalents are used herein to mean that other components or steps are optionally present. For example, an article comprising A, B, and C includes an article having only A, B, and C as well as articles having A, B, C, and other components. And a method comprising the steps A, B, and C includes methods having only the steps A, B, and C as well as methods having the steps A, B, C, and other steps.

Terms of degree, such as "substantially," "about," and "roughly" are used herein to denote features that satisfy their technological purpose equivalently to a feature that is "exact." For example, a component A is "substantially" perpendicular to a second component B if A and B are at an angle such as to equivalently satisfy the technological purpose of A being perpendicular to B.

Except as otherwise stated herein, or as is otherwise clear from context, the term "or" is used herein in its inclusive sense. For example, "A or B" means "A or B, or both A and B."

FIG. 1 is a three-dimensional depiction of an exemplary cooling cabinet 100 illustrating the air flow within the cabinet. The air flow is indicated by the dashed arrows. The cooling cabinet includes a display section 102 and a cooling section 104. The cooling section includes a cooling fan 200 and an evaporator coil 106. The fan 200 is tilted to be neither horizontal nor vertical. Air is drawn down from the display section 102 into the cooling section 104 by the fan 200 at one side of the cabinet 100 (the "front" side). The output of the fan flows to and through the coil 106. The coil 106 operates to cool the air that flows through the coil 106 and the cooled air then flows back up into the display section 102, cooling items located in the display section 102.

Figure 2:
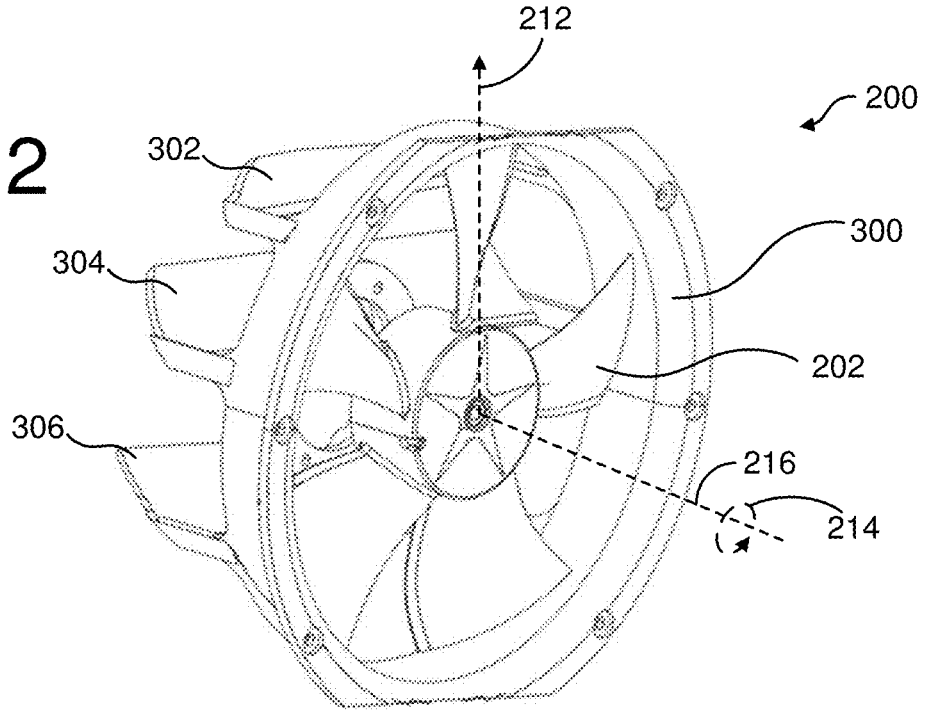
FIG. 2 is a 3D view illustrating an exemplary cooling-fan shroud according to an aspect of the invention.

FIG. 2 is a three-dimensional depiction of an exemplary fan 200 comprising an impeller 202 and a shroud 300 (the fan motor is omitted for sake of clarity). The shroud includes three deflector vanes 302, 304, 306 positioned on the pressure (exhaust) side of the impeller 202. FIG. 2 illustrates the position of the exemplary deflector vanes 302, 304, 306 relative to the impeller 202. The impeller is configured to rotate 214 about an axis 216 so that air flows out along the axial direction. The deflector vanes 302, 304, 306 are curved elongate plates having a longitudinal axis extending across the perimeter of the roughly circular shroud body 300 at different points along the radial 212 direction (transverse to the axis of rotation 216).

FIGS. 3A-3D are three-dimensional, front, side, and top views, respectively, illustrating the exemplary shroud 300. An orthogonal coordinate system 310 is used herein to describe the exemplary shroud 300. The coordinate system 310 includes x 312, y 314, and z 316 axes. The z axis 316 corresponds to the axis of rotation 216 defined with reference to FIG. 2 and is directed in the direction of axial air flow. The x axis 312 corresponds to the horizontal direction when the shroud 300 is installed in a cooling cabinet as described with reference to FIG. 1. The shroud 300 includes a substantially cylindrical shroud body 308 having a cylindrical axis 303 coaxial with the axis of rotation 216. Three curved deflector vanes 302, 304, 306 are connected to the shroud body 308 at the exhaust side of the shroud 300, near a fan-motor mount 301. Each deflector vane 302, 304, 306 is a plate spanning two points on the periphery of the shroud body 308. The deflectors 302, 304, 306 are distributed at different positions along the y axis. (As used herein, the "length" of the vane extends between the two points on the periphery and the "width" (or "chord length") of the vane extends from the edge of the vane nearest to the shroud body 308 to the edge of the vane farthest from the shroud body 308. The length may vary along the width and the width may vary along the length.) Each vane 302, 304, 306 has a flow-facing surface 302*a*, 304*a*, 306*a*. Each surface 302*a*, 304*a*, 306*a* may be curved along its width or its length. (The surfaces 302*a*, 304*a*, 306*a* do not necessarily have the same curvature.) Each vane is angled with respect to the axial direction (z axis 316) such that curved surfaces 302*a*, 304*a*, 306*a* are facing toward the direction of airflow: air flowing out of the fan flows onto the surfaces 302*a*, 304*a*, 306*a* and the flow is thereby deflected. (As used herein, the angle 318 the surface 302*a*, 304*a*, 306*a* makes with the axial direction 316 is the "facing angle" and is defined as the angle between the axial direction and the tangent to the surface at a midpoint along the width of the surface. The facing angle may vary along the length of the vane. The "mean facing angle" is the mean of the facing angles along the length of the vane.) The curvature and facing angle of each deflector vane 302, 304, 306 may be tuned to deflect the flow in a desired manner for a specific application. In a preferred embodiment, the mean facing angle is different for each deflector vane 302, 304, 306 and the curvatures of the surfaces 302*a*, 304*a*, 306*a* are not identical.

Figure 3A:
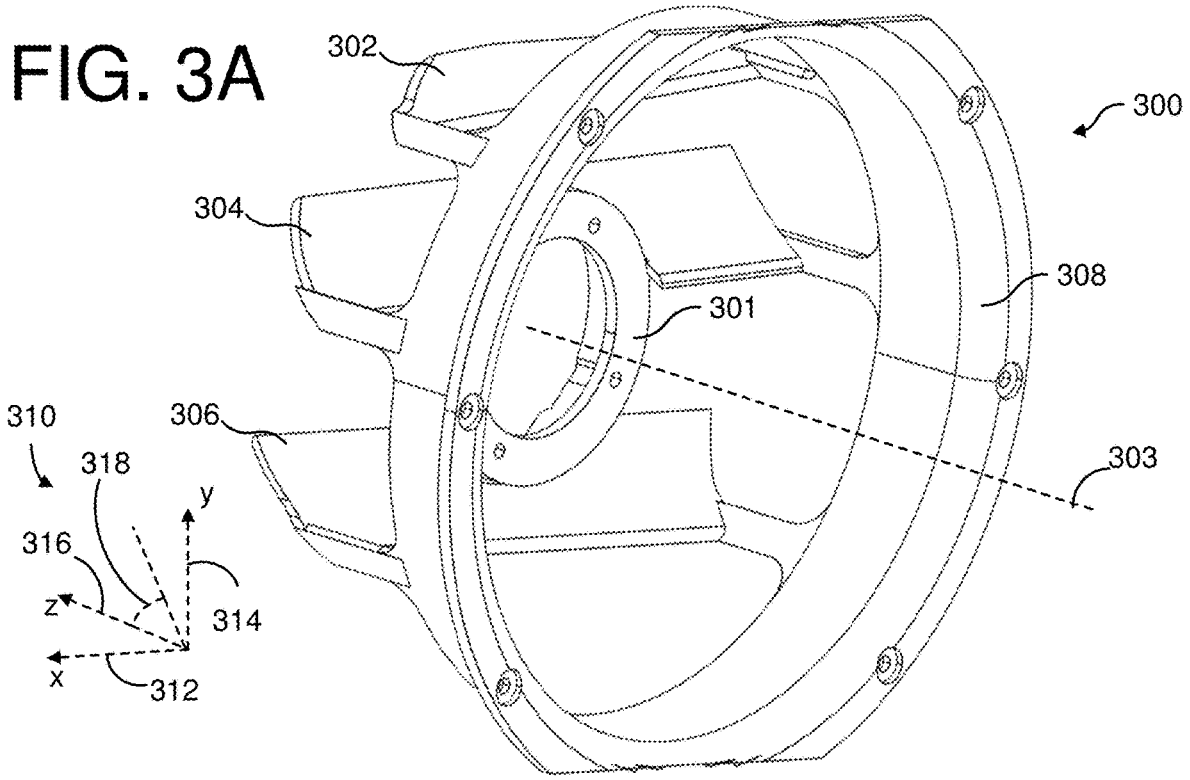
FIGS. 3A-3D are various views illustrating an exemplary cooling-fan shroud according to an aspect of the invention.
Figure 3B:
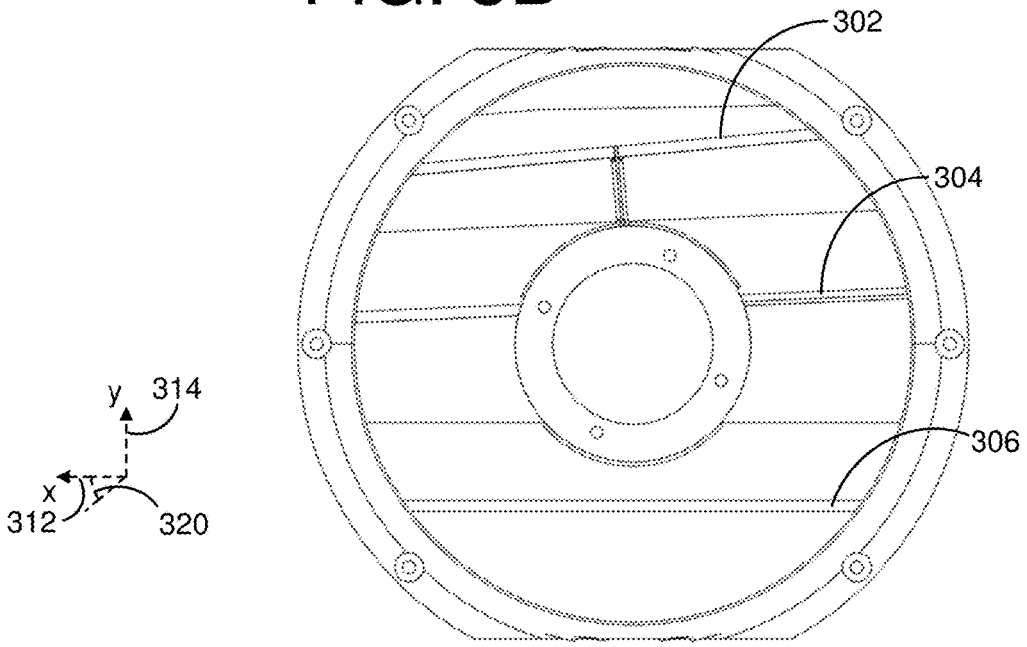
Figure 3C:
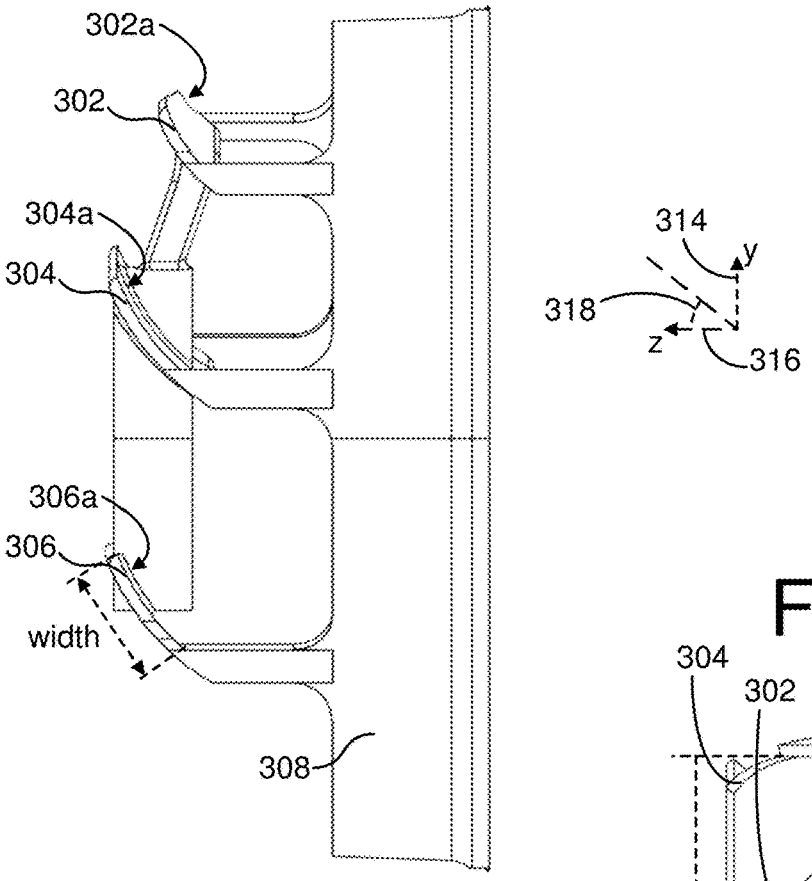
Figure 3D:
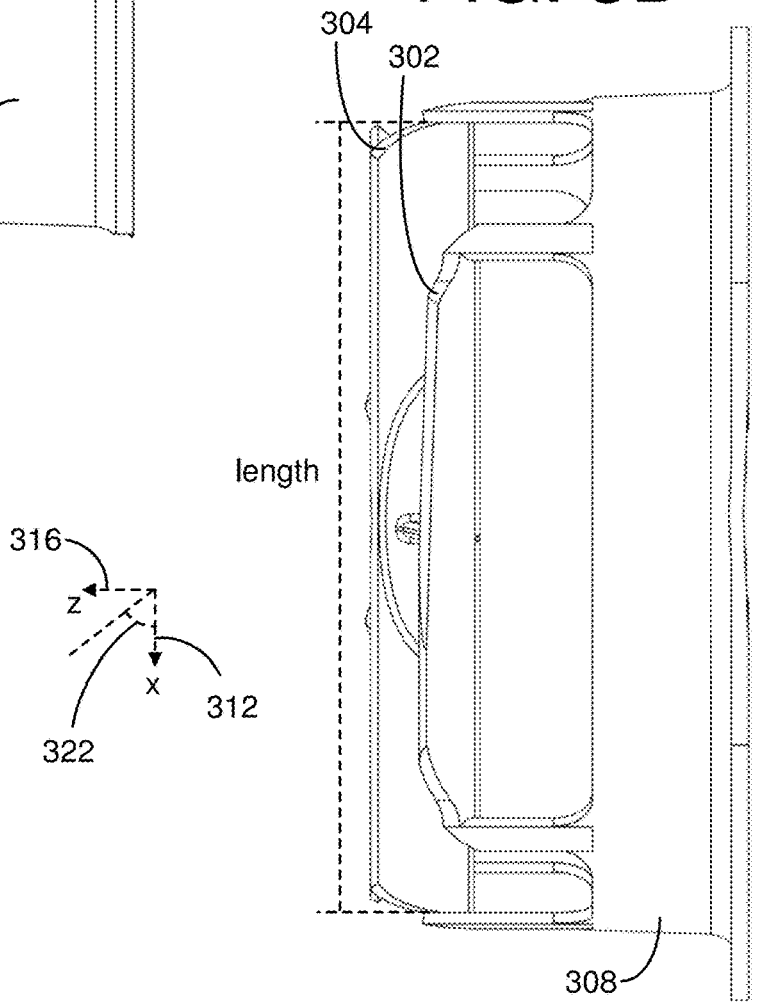

As depicted in FIG. 3B, the deflectors 302, 304, 306 do not intersect but are not necessarily parallel. Each vane 302, 304, 306 may be angled with respect to the x axis 312. (As used herein, the angle 320 the surface 302*a*, 304*a*, 306*a* makes with the x axis 312 is the "tilt angle" and is defined as the angle between the x axis and the tangent to the surface at a midpoint along the width of the surface. The tilt angle may vary along the length of the vane. The "mean tilt angle" is the mean of the tilt angles along the length of the vane.) The tilt angle of each deflector vane 302, 304, 306 may be tuned to deflect the flow in a desired manner for a specific application. In a preferred embodiment, the mean tilt angle is different for each deflector vane 302, 304, 306. In a preferred embodiment the tilt angles of the deflector vanes 302, 304, 306 differ from each other by no more than 4 degrees.

The deflectors 302, 304, 306 are placed at point along the z-axis 316 to provide a distance from the fan impeller. Each deflector 302, 304, 306 may be placed at a different point such that each is at a different distance from the impeller. This distance may vary along the length of the deflector such that the deflector is not parallel to the xy plane 312/314. (As used herein, the angle 322 the surface 302*a*, 304*a*, 306*a* makes with the xy plane 312/314 axis 312 is the "elevation angle" and is defined as the angle between the xy plane and the tangent to the surface at a midpoint along the width of the surface. The elevation angle may vary along the length of the vane. The "mean elevation angle" is the mean of the elevation angles along the length of the vane.) In a preferred embodiment the elevation angles of the deflector vanes 302, 304, 306 differ from each other by no more than 2 degrees.

Figure 4:
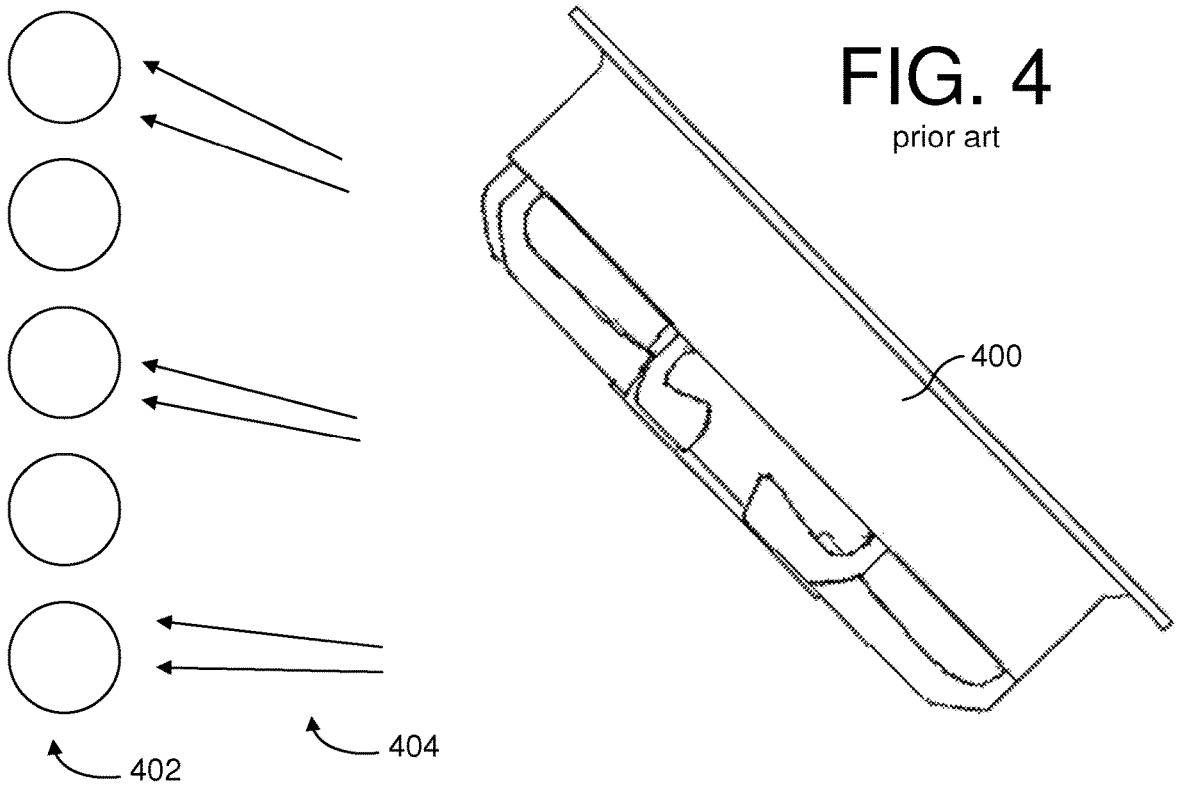
FIG. 4 prior art
FIG. 4 is a side view of an exemplary air flow illustrating the non-uniformity of the air flow from a prior-art cooling-fan shroud.
Figure 5:
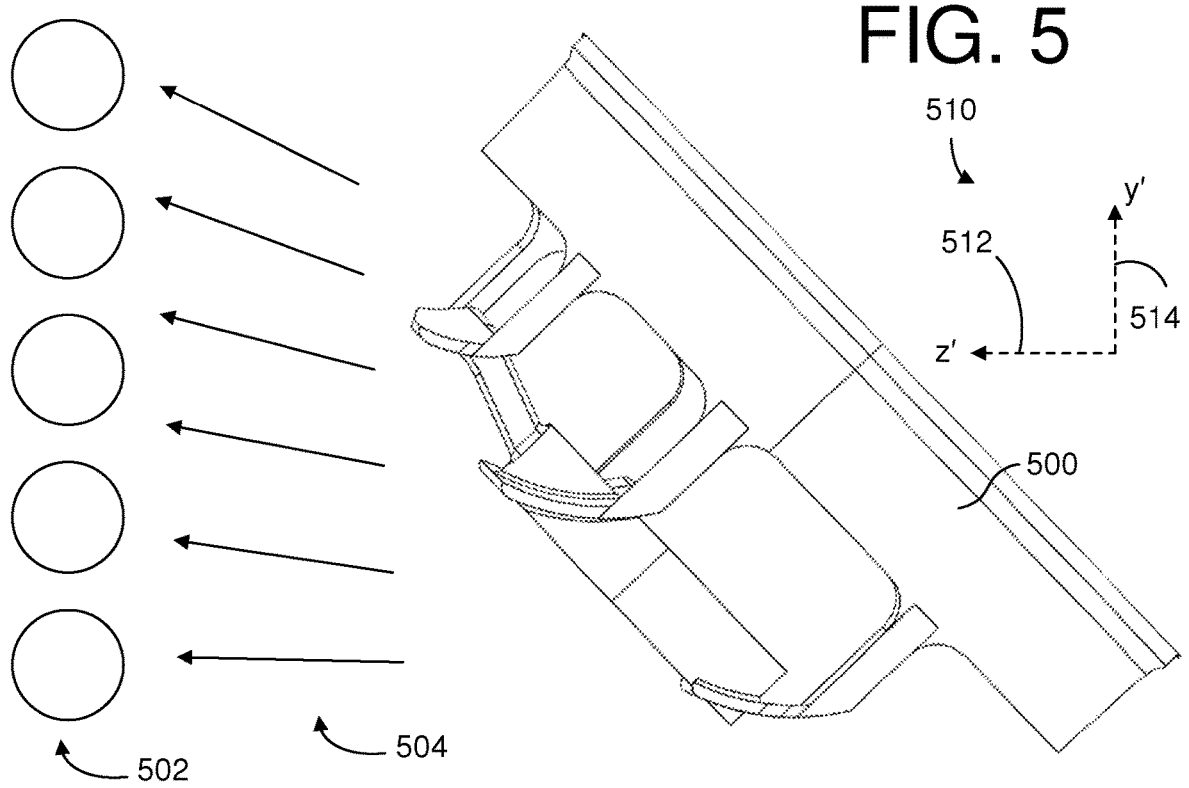
FIG. 5 is a side view of an exemplary air flow illustrating the uniformity of the air flow from a cooling-fan shroud according to an aspect of the invention.

FIGS. 4 and 5 are side views illustrating the different air-flow patterns 404, 504 one might expect from a prior-art fan shroud 400 and an exemplary fan shroud 500 according to an aspect of the invention. In FIG. 4, air 404 flowing out of the prior-art shroud 400 is non-uniform on reaching the evaporator coils 402. The air flow is indicated by the arrows and closely spaced arrows indicate regions of greater air flow. The prior-art fan shroud 400 yields an air flow with regions of relatively high flow rate and regions of relatively low flow rate as the air passes by the coils. This results in some air being cooled more or less than other air and lowers the overall cooling efficiency. In FIG. 5, air 504 flowing out of the inventive shroud 500 is uniform (or relatively more uniform than the prior art) on reaching the evaporator coils 502. The air flow is indicated by the arrows and the evenly spaced arrows indicate a substantially uniform air flow across the coils 502. The inventive fan shroud 500 yields an air flow with a relatively uniform flow rate as the air passes by the coils. This results in a substantially uniform air cooling and increases the over all cooling efficiency relative to the prior-art shroud 400.

Figure 6:
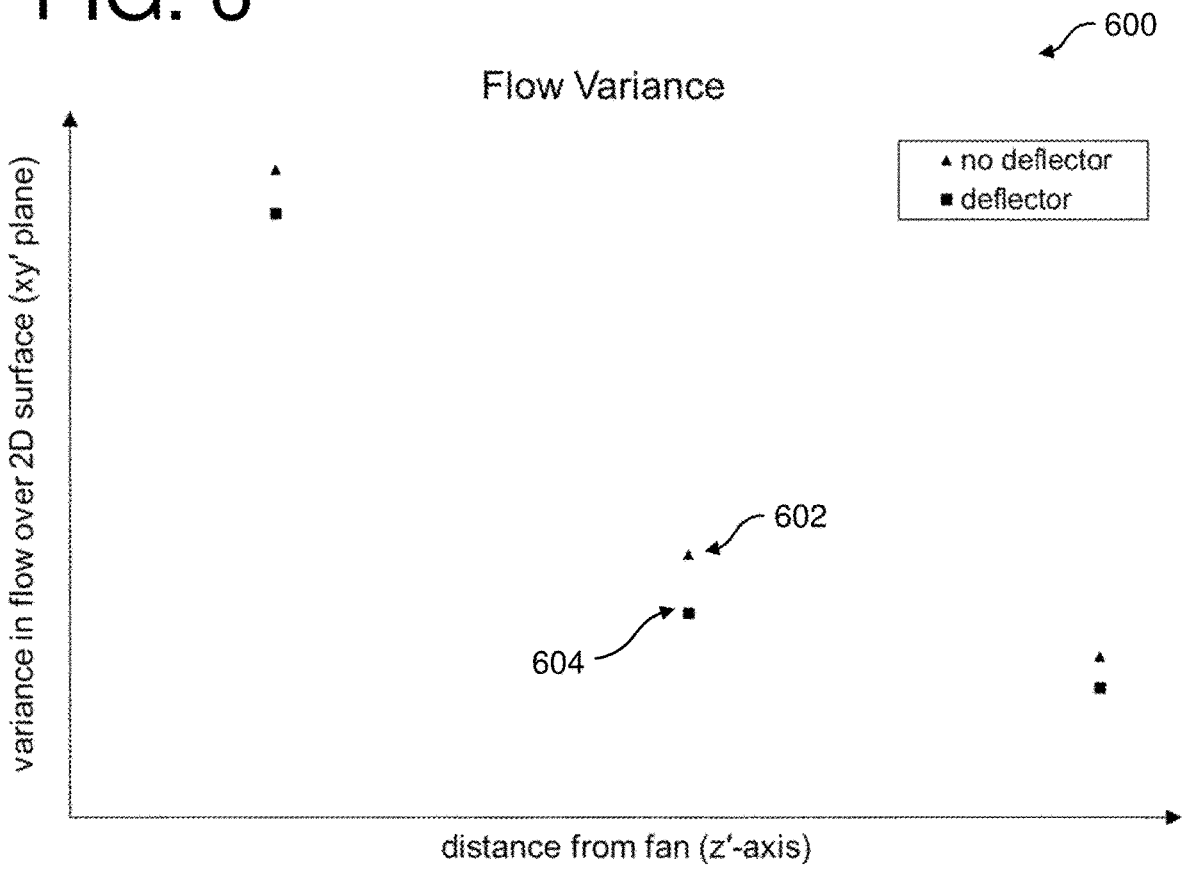
FIG. 6 is a graph illustrating improvements to the uniformity of air flow through the use of a cooling-fan shroud according to an aspect of the invention.

FIG. 6 is a graph 600 illustrating exemplary variances in flow across planes at various distances from the fan. For purpose of this graph, the coordinate system 510 depicted in FIG. 5 is used. The direction from the fan toward the evaporator coils is the z' direction 512. The plane transverse to that direction is the xy' plane 514. The "flow variance" is a measure of the variance of the flow across the transverse xy' plane of the coils at various distance from the fan, and thus at various points through the coil. Lower variance indicates greater uniformity. Data for a fan with a deflector according to an aspect of the invention is indicated with a square marker 604. Data for a fan without such a deflector is indicated with a triangular marker 602. For both fans, the flow uniformity increases (variance decreases) with distance from the fan, as the flow progresses through the coil. At all distances, the uniformity of the air flow through the coil was better for the fan with the deflectors.

By including a plurality of specially-configured deflector vanes on the output side of a fan shroud, one can deflect the air to provide a more uniform air flow across an evaporator coil. This yields better cooling efficiency than systems with less uniform air flow across the coils. The curvature, facing angle, tilt angle, and elevation angle of the deflector vanes may be tuned for particular applications based on, e.g., geometry and airflow. In cooling cabinets, for example, a cooling system may be tuned for decreased size in order to increase display capacity for a given cooling cost or the cooling system may be tuned to decrease cooling cost without decreasing display capacity (or some combination thereof).

While the foregoing description is directed to the preferred embodiments of the invention, other and further embodiments of the invention will be apparent to those skilled in the art and may be made without departing from the basic scope of the invention. And features described with reference to one embodiment may be combined with other embodiments, even if not explicitly stated above, without departing from the scope of the invention. The scope of the invention is defined by the claims which follow.

The invention claimed is:

1. A fan shroud for an axial fan impeller having an axis of rotation and an axial direction of air flow, the shroud comprising:

(a) a roughly cylindrical body comprising:
  (i) a periphery defining a cavity configured to receive the axial fan impeller,
  (ii) a longitudinal axis that is configured to be coaxial with the impeller's axis of rotation when the impeller is placed in the cavity,
  (iii) an x axis extending radially from the longitudinal axis, and
  (iv) a y axis extending radially from the longitudinal axis and perpendicular to the x axis, (b) a plurality of air-deflector vanes connected to the body, each vane having a length spanning points on the periphery, a width, and a flow-facing surface;

(c) wherein each air-deflector vane is disposed at a longitudinal-axial position apart from the cavity in the direction of the air flow;

(d) wherein each air-deflector vane's flow-facing surface has a facing angle relative to the longitudinal axis such that the flow-facing surface is neither parallel nor perpendicular to the longitudinal axis; and (e) wherein each air-deflector vane's flow-facing surface has a tilt angle relative to the x axis.

2. The fan shroud of claim 1 wherein each facing angle is between 40 degrees and 60 degrees.

3. The fan shroud of claim 1 wherein each facing angle varies along the length of the vane by no more than 2 degrees.

4. The fan shroud of claim 1 wherein at least two facing angles differ from each other.

5. The fan shroud of claim 1 wherein at least one flow-facing surface is concave.

6. The fan shroud of claim 1 wherein each flow-facing surface has a curvature that is not zero.

7. The fan shroud of claim 1 wherein each flow-facing surface has a curvature that differs from the curvature of every other flow-facing surface.

8. The fan shroud of claim 1 wherein at least two tilt angles differ from each other.

9. The fan shroud of claim 1 wherein maximum difference between any two tilt angles is 5 degrees.

10. The fan shroud of claim 1 wherein each air-deflector vane is disposed at a longitudinal-axial position that differs from the longitudinal-axial position of every other air-deflector vane.

11. A cooling fan comprising:

(a) a fan shroud comprising a body with a periphery defining a cavity;

(b) an axial impeller disposed within the cavity and having an axis of rotation and an axial direction of air flow;

(c) a first air-deflector vane having a first length, a first width, a first longitudinal axis, and a first flow-facing surface, the first air-deflector vane connected to the body with the first length spanning points on the periphery; and (d) a second air-deflector vane having a second length, a second width, a second longitudinal axis, and a second flow-facing surface, the second air-deflector vane connected to the body with the second length spanning points on the periphery, wherein the second length is different from the first length and the second width is different from the first width;

(e) wherein the first air-deflector vane is positioned adjacent to the impeller and spaced apart from the impeller in the axial direction of air flow such that the first flow-facing surface forms a facing angle relative to the axial direction of air flow of between 45 and 70 degrees and the first longitudinal axis forms an angle with the axial direction of air flow between 80 and 100 degrees; and (f) wherein the second air-deflector vane is positioned adjacent to the impeller and spaced apart from the impeller in the axial direction of air flow such that the second flow-facing surface forms a facing angle relative to the axial direction of air flow of between 45 and 70 degrees and the second longitudinal axis forms an angle with the axial direction of air flow between 80 and 100 degrees.

12. The cooling fan of claim 11 further comprising a third air-deflector vane having a third length, a third width, a third longitudinal axis, and a third flow-facing surface.

13. The cooling fan of claim 12 wherein the third length is different from the first length and the second length and the third width is different from the first width and the second width.

14. The cooling fan of claim 11 wherein the first flow-facing surface has a first non-zero curvature.

15. The cooling fan of claim 14 wherein the second flow-facing surface has a second non-zero curvature that is different from the first non-zero curvature.

16. The cooling fan of claim 11 wherein the first air-deflector vane is spaced apart from the impeller a first distance and the second air-deflector vane is spaced apart from the impeller a second distance and the first distance is different from the second distance.

* * * * *